US007810641B2

(12) United States Patent
Hungler et al.

(10) Patent No.: US 7,810,641 B2
(45) Date of Patent: Oct. 12, 2010

(54) PARALLELEPIPEDAL FLEXIBLE PACKAGING WITH BREAKABLE ZONE

(75) Inventors: Joel Hungler, Ailly (FR); Yves-Michel Malecot, Crosville la Vieille (FR); Nicolas Pommier, Colmar (FR); Gilles Cattacin, Colmar (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 12/199,355

(22) Filed: Aug. 27, 2008

(65) Prior Publication Data

US 2009/0057172 A1 Mar. 5, 2009

(30) Foreign Application Priority Data

Aug. 31, 2007 (FR) ..... 07 06115

(51) Int. Cl.
*B65D 73/00* (2006.01)

(52) U.S. Cl. ..... 206/494; 206/233; 229/240; 229/242; 383/200; 383/209

(58) Field of Classification Search ..... 206/494, 206/233, 499, 526, 805; 383/200, 209, 210; 229/242, 240

See application file for complete search history.

(56) References Cited

U.S. PATENT DOCUMENTS 2,137,398 A * 11/1938 Helber ..... 221/63
3,620,438 A * 11/1971 Wood et al. ..... 229/205
4,212,395 A * 7/1980 Korte ..... 229/237
4,934,535 A 6/1990 Muckenfuhs et al.
5,054,619 A * 10/1991 Muckenfuhs ..... 206/494
5,069,332 A * 12/1991 Williams et al. ..... 206/6.1
5,666,445 A * 9/1997 Conrad et al. ..... 383/207
7,310,922 B2 * 12/2007 Carrigan et al. ..... 53/399
2006/0266815 A1 11/2006 Coltri-Johnson et al.

FOREIGN PATENT DOCUMENTS

EP 0628005 B1 6/2000

OTHER PUBLICATIONS

French Search Report that issued Jan. 10, 2008, in connection with French Patent Application No. 07 06115.

* cited by examiner

*Primary Examiner*—David T Fidei
(74) *Attorney, Agent, or Firm*—Laura L. Bozek

(57) ABSTRACT

The invention relates to a flexible packaging of parallelepipedal form for flexible, superposed flat elements, which may or may not be interlinked, forming a stack of axis XX, comprising a breakable zone (1) capable of constituting a dispensing opening that is initially closed and delimited by a line of weakening (2), said zone (1) extending over three faces (11, 12, 13) of the packaging. The breakable zone (1) is circular, or substantially circular, of diameter D, the greater part of the zone (1) is centred on one (11) of the faces of the packaging perpendicular to the stacking axis XX, and the other two parts of the breakable zone (1) being arranged on two faces (12, 13) of the packaging that are parallel to the axis XX of the stack.

2 Claims, 2 Drawing Sheets

PARALLELEPIPEDAL FLEXIBLE PACKAGING WITH BREAKABLE ZONE

CROSS REFERENCE TO RELATED APPLICATIONS

This application claims priority to copending French patent application number 07 06115, filed Aug. 31, 2007, the disclosure of which is incorporated herein by reference in its entirety.

BACKGROUND OF THE INVENTION

The present invention relates to the field of packaging, more specifically that formed by a flexible material, for example packaging made from plastic, of generally parallelepipedal form and capable of containing folded products, such as handkerchiefs, towels or wipes, or any type of cellulose-fibre-based absorbent paper product.

The products contained inside such packagings are folded, optionally interlinked, stacked and compressed inside the packaging. They thus form a stack from which a product may be removed when the packaging is partially open. The user then pulls on the product or on a part of the product projecting from the stack.

Packagings of this type are known, such as that described, for example, in patent EP 0 628 005 B1, which relates to a packaging for disposable nappies, which is provided with a bellows and with a handle on one of its faces, and with an associated breakable zone that forms the exit for the disposable nappies. A plurality of forms and arrangements of openings are envisaged in said document.

U.S. Pat. No. 4,934,535 relates to a packaging of the same type, with handle and associated opening.

The first problem associated with this type of packaging concerns the pressure exerted by the stack of products on the two opposite faces of the packaging. The products, initially compressed inside the packaging, actually exert, on the walls of the packaging, a force perpendicular to the principal fold surface.

If the opening (or the openings) in the packaging is (are) arranged parallel to said surface, it thus experiences a force induced by said compression.

The dispensing opening should not be too large as compared with the total surface area of the relevant face, with a view to preventing untimely exit of products through said opening. It cannot be too small either, since it must be possible for the products to be removed from the packaging without excessive friction, which could crumple them and/or tear them, for example.

BRIEF DESCRIPTION OF THE INVENTION

According to the invention, the packaging may be used either alone or inside a dispenser. This potential dual use creates constraints and problems that known packagings are unable to solve.

For use in a dispenser, it is attempted not only to limit the dispensing opening in order to be able easily to position the already open packaging containing the stack of products into the dispenser without any product falling out, but also to have available as large an opening as possible in order to reduce friction on the packaging and to allow the removal of the products whilst keeping the packaging inside the dispenser.

As regards use on its own, without a dispenser, the dispensing opening of a packaging according to the invention has to be as small as possible for hygiene reasons, but has to remain sufficiently wide in order to allow easy, direct grasping of the products.

The solution that is compatible with these contradictory requirements leads to part of the packaging being retained on the periphery of the dispensing surface.

Thus, the present invention relates to a flexible packaging of parallelepipedal form for flexible, superposed flat elements, which may or may not be interlinked, forming a stack of axis XX, comprising a breakable zone capable of constituting a dispensing opening that is initially closed and is delimited by a line of weakening, said zone extending over three faces of the packaging.

According to the invention, said breakable zone is circular or substantially circular of diameter D, the greater part of said zone is centred on one of the "dispensing" faces of the packaging, perpendicular to the stacking axis XX, and the other two parts of the breakable zone are arranged on two faces of the packaging that are parallel to the axis XX of the stack.

In these circumstances, the dimensions and the position of said breakable zone vis-à-vis the packaging are such that the diameter D of the opening complies with:

$$D=L-(M1+M2).$$

With M1 and M2 between 5 mm and L/3, L being the length of the dispensing face perpendicular to the stacking axis XX, M1 and M2 being the distances measured, respectively, along the length of the dispensing face, between the ends of the breakable zone and those of the face.

More precisely, M1 and M2 may be between 10 and 15 mm.

Furthermore, the dimensions and the position of said breakable zone vis-à-vis the packaging are such that the diameter $D=P+O_1+O_2$.

With P=width of the dispensing face, $O_1$ and $O_2$=distances measured, respectively, along the stacking axis XX between an edge of the dispensing face and the end of the breakable zone, $O_1$ and $O_2$ being between 5 mm and the initial height H of the packaging measured along the stacking axis XX.

More specifically, the dimensions $O_1$ and $O_2$ are of the order of H/2.

The packaging according to the invention also comprises a means for compression along the axis XX of the stack.

BRIEF DESCRIPTION OF THE DRAWINGS

Further characteristics, details and advantages of the invention will become more apparent upon reading the following description, which is given by way of illustration and is in no way limiting, with reference to the appended drawings, in which.

DETAILED DESCRIPTION OF THE INVENTION

Figure 1:
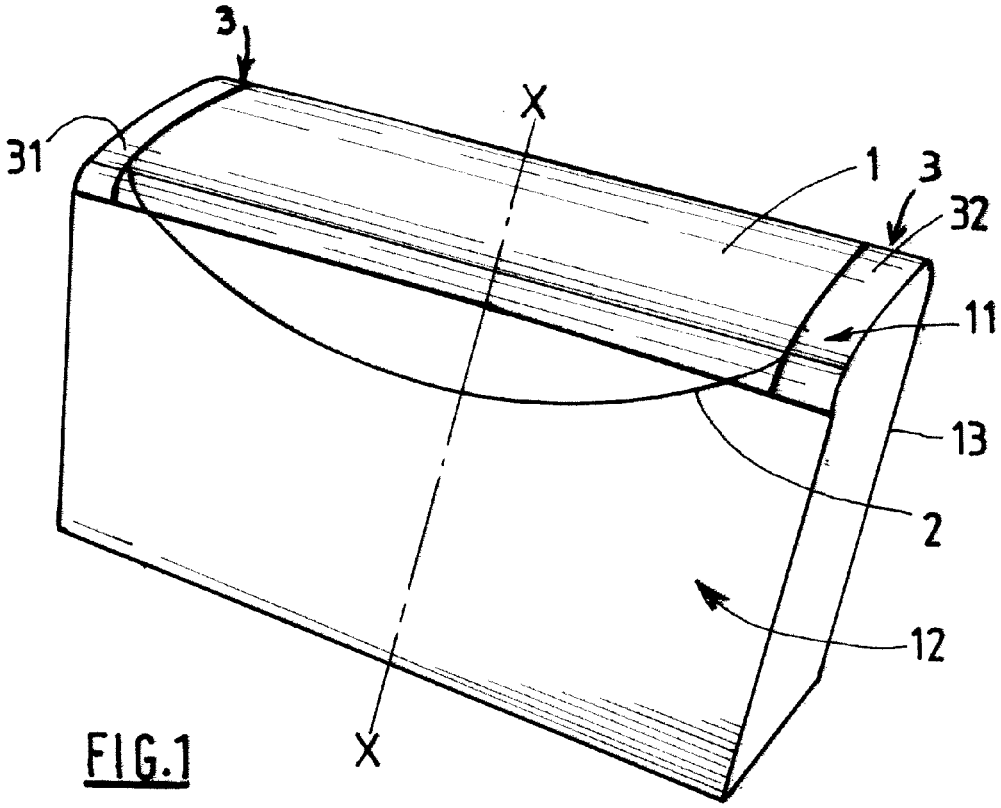
FIG. 1 is a perspective diagram of a first embodiment of a packaging according to the invention.

The packaging as shown in FIG. 1, of substantially parallelepipedal form, in this case contains folded, interlinked sheets of absorbent paper that form a stack of axis XX.

The packaging comprises a breakable zone 1 capable of constituting a dispensing opening that is initially closed and delimited preferably by perforations 2 or pre-cutouts. A breakable zone is in this case a zone delimited by a line whereby the material (forming the breakable zone) is weakened so that it can constitute a weak cutout line when a user pulls on said breakable zone.

The packaging may consist, for example, of a plastic film made from polypropylene or polyethylene that is 5 to 50 μm in thickness. Any equivalent material that is both flexible and strong may be envisaged without departing from the scope of the invention.

The breakable zone 1 is of ovoid form and extends essentially over one of the faces of the packaging perpendicular to the axis XX of the stack. The breakable zone extends, furthermore, over two faces 12, 13 of the packaging, parallel to the axis XX.

Figure 3:
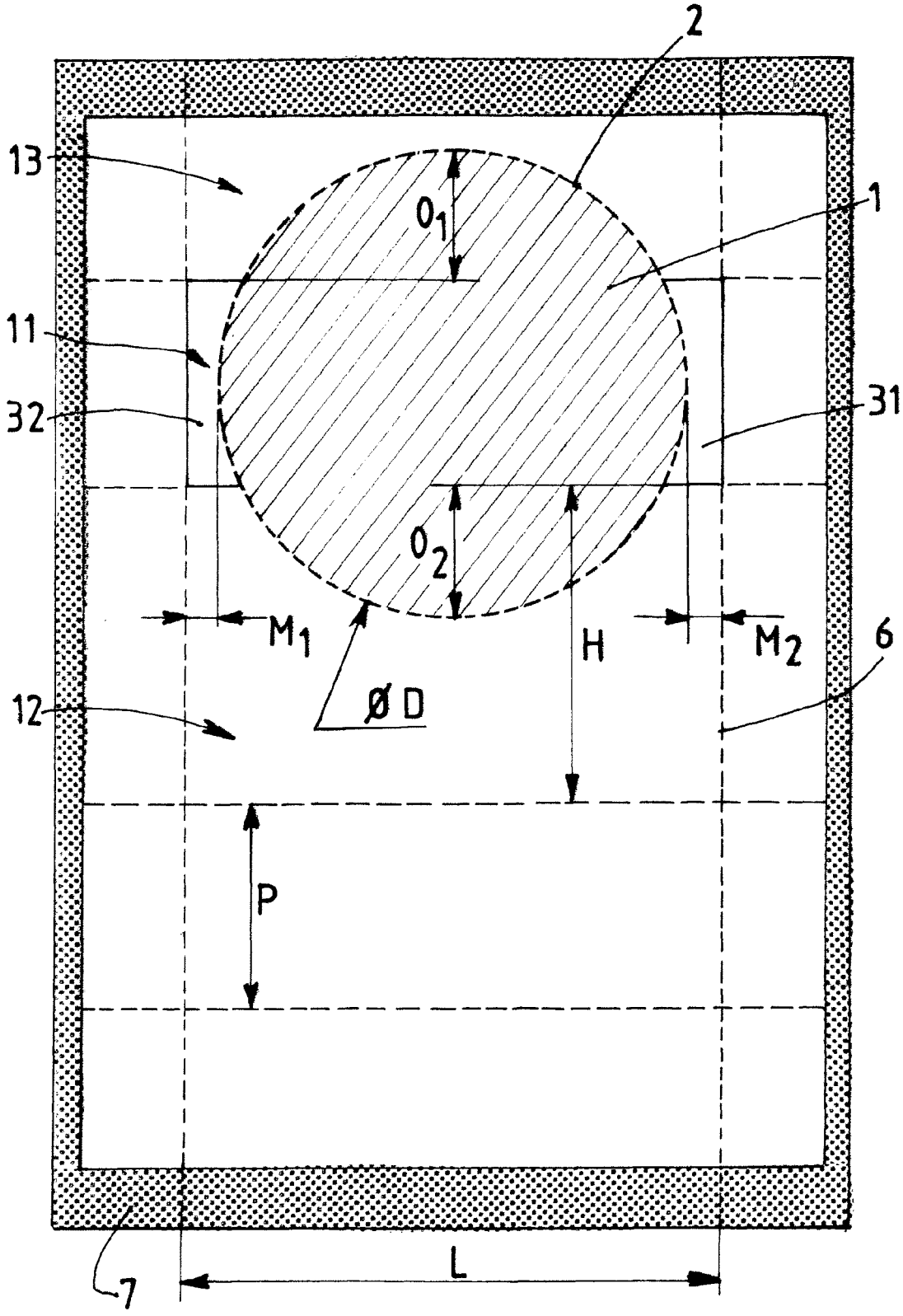
FIG. 3 is a flat-form representation of a packaging according to the invention.

According to a preferred embodiment of the invention, the zone 1 is circular, of diameter D and is positioned as shown in FIG. 3.

Globally, the zone 1 is centred on the face 11 of the packaging, known as dispensing face 11, of which it occupies the greater part, and it also extends over the two faces 12, 13 as portions of a circle.

The aim is to achieve an opening that is as large as possible, for satisfactory grasping of the sheets, on the dispensing face 11, on which the thrust of the stack is directly exerted (according to the axis XX).

However, this opening must also make it possible to keep the stack in place and thus to oppose the pressure exerted by the stack of sheets, particularly at the start of use, when the stack is likely still to be very compressed inside the packaging.

To that end, a holding zone 3 is provided on either side of the breakable zone 1. This holding zone corresponds substantially to two mutually parallel lateral bands 31, 32 located on either side of the breakable zone 1 and delimited externally by the edges of the dispensing face 11 of the packaging.

In any event, said holding zone 3 will comprise at least the zones near to the four corners of the dispensing face 11.

Tests have been done with varied forms and arrangements of the breakable zone 1 vis-à-vis the packaging, and the following non-obvious, innovative characteristics have been observed.

A breakable zone 1 of circular form is preferred. It is very easy to produce.

The form and the position of the breakable zone 1 are such that:

$D=L-(M1+M2)$, with M1 and M2 being between 5 mm and L/3.

As indicated in FIG. 3, D is the diameter of the breakable circle 1,

L is the length of the dispensing face 11 of the packaging,

M1 and M2 are the distances measured, respectively, along the length of the dispensing face 11, between the ends of the opening and those of the face.

Very satisfactory results have been obtained with M1 and M2 being between 10 and 15 mm.

The breakable zone 1 furthermore extends over two other faces of the packaging, which are contiguous with the dispensing face 11.

More precisely, the zone 1 extends over two faces 12, 13 corresponding to the height H of the stack.

Advantageously, the circular breakable zone 1 has a diameter D such that $D=P+O_1+O_2$; P being the width of the packaging, i.e. in fact, the width of the stacked sheets, $O_1$ and $O_2$ being the respective distances measured along the axis XX of the stack, between an edge of the dispensing face 11 and the end of the breakable zone 1.

Figure 2:
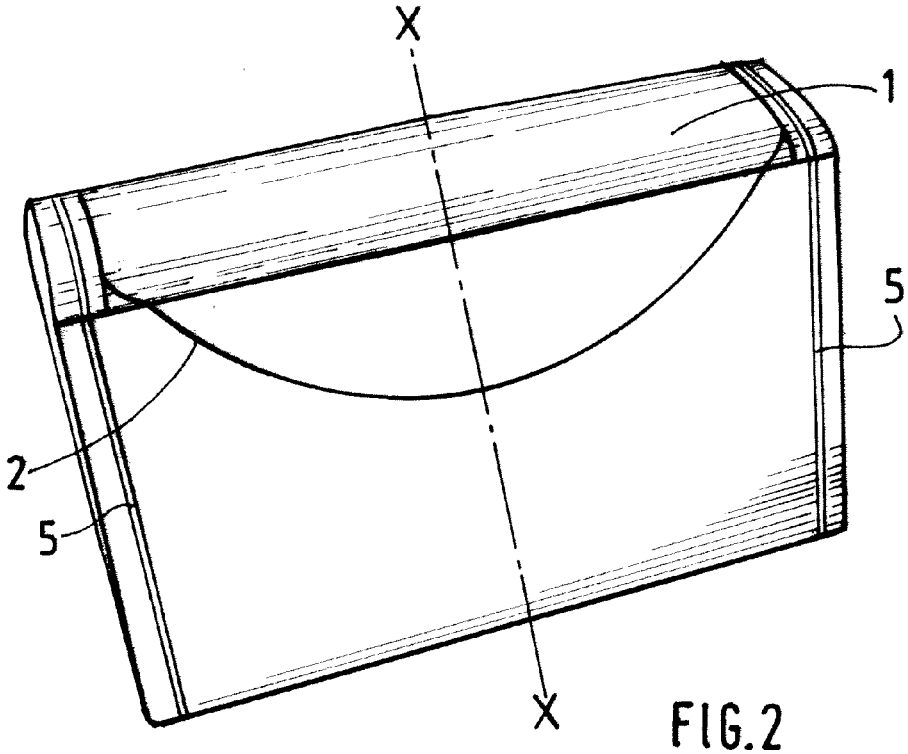
FIG. 2 is a perspective diagram of a second embodiment of a packaging according to the invention.

FIG. 3 illustrates, precisely, the values D, P, L, H, $O_1$ and $O_2$ in connection with and supplemental to FIGS. 1 and 2.

FIG. 2 shows an improved version of the packaging already described in connection with FIG. 1.

The improvement relates to a means for compressing the packaging along the axis XX of the stack.

By way of non-limiting example, the compression means comprises two elastic elements 5 surrounding said packaging, arranged on either side of the breakable zone 1, as may be seen in FIG. 2.

The compression means 5 makes it possible to make the opening 1 coincide with the surface of the top sheet in the stack and to maintain contact therebetween, the sheet contiguous with the opening being the first to be removed, irrespective of the height of the stack.

As shown in FIG. 3, in connection with the packaging laid flat, the breakable zone 1 is circular and extends over three faces of the packaging, i.e. the dispensing face 11 and the two adjacent faces 12 and 13, which extend over the height of the stack of sheets.

The dashed zones 6 correspond to the fold lines of the packaging, which delimit the edges of the parallelepiped formed by the stack of folded products.

Of course, without departing from the scope of the invention, the breakable zone 1 could be ovoid, oval or another shape, all while preserving this arrangement.

The distances M1, M2 have to comply with certain limit values in order, in particular, to ensure that there is a surface compatible with the two examples of use envisaged: the packaging alone and the packaging in a dispenser.

Similarly, $O_1$, $O_2$ have to comply with limit values, particularly in terms of the height H.

Lastly, FIG. 3 shows, as a hatched zone, the contour 7 of the packaging, which may correspond to zones of overlap and/or of adhesive bonding of the material constituting the packaging.

What is claimed is:

1. A flexible packaging of parallelepipedal form for flexible, superposed flat elements, which may or may not be interlinked, forming a stack of axis XX, the flexible packaging comprising:

a flexible plastic film comprising a breakable zone capable of constituting a dispensing opening that is initially closed and delimited by a line of weakening, the breakable zone extending over three faces of the parallelepipedal form, one of the three faces being oriented perpendicular to the stacking axis XX, the other two of the three faces being oriented parallel to the stacking axis XX, the breakable zone being circular, or substantially circular, of diameter D, a greater part of the breakable zone being centered on the one of the three faces, and another two parts of the breakable zone being separately arranged on the other two of the three faces of the film, a holding zone disposed on each side of the breakable zone on the one of the three faces, and an elastic element disposed at each of the holding zones on an external surface of the film and surrounding the stack, thereby providing a means of compression to the stack, irrespective of the height of the stack, while permitting individual ones of the flat elements of the stack to be removed through the opening of the packaging absent direct contact between the flat elements and the elastic elements.

2. The packaging according to claim 1, wherein the flexible plastic film has a thickness equal to or greater than 5 micrometers and equal to or less than 50 micrometers.

* * * * *